US005119547A

United States Patent [19]

Ii

[11] Patent Number: 5,119,547

[45] Date of Patent: Jun. 9, 1992

[54] MEANS FOR SEPARATING MALE AND FEMALE HOUSINGS OF AN ELECTRIC CONNECTOR

[75] Inventor: Hidehiro Ii, Yokohama, Japan

[73] Assignee: Molex Incorporated, Lisle, Ill.

[21] Appl. No.: 701,336

[22] Filed: May 10, 1991

Related U.S. Application Data

[63] Continuation of Ser. No. 561,394, Jul. 31, 1990, abandoned.

[30] Foreign Application Priority Data

Sep. 1, 1989 [JP] Japan ..... 1-103098[U]

[51] Int. Cl.[5] ..... H01R 43/00

[52] U.S. Cl. ..... 29/764; 29/426.6; 29/758

[58] Field of Search ..... 29/764, 758, 747, 235, 29/426.6

[56] References Cited

U.S. PATENT DOCUMENTS

| | | | |
|---|---|---|---|
| 3,896,535 | 7/1975 | Tucci | 29/758 X |
| 4,155,159 | 5/1979 | Hogan et al. | 29/764 |
| 4,290,193 | 9/1981 | Anderton et al. | 29/764 |
| 4,425,704 | 1/1984 | Cline | 29/764 |

*Primary Examiner*—Carl E. Hall
*Attorney, Agent, or Firm*—Stephen Z. Weiss

[57] ABSTRACT

A tool for pulling and removing the male housing of an electric connector away from the receptacle space of the female housing. The male housing has a plurality of slots to accommodate terminals, each terminal having a length of wire connected thereto. The tool includes a shank and a tool body integrally connected thereto. The tool body has a wide-and-short leg and a narrow-and-long leg in the form of a fork. The narrow-and-long leg has a lock projection on its rear side to be engaged by a lock recess or hole on the rear wall of the terminal slot in the male housing.

3 Claims, 6 Drawing Sheets

MEANS FOR SEPARATING MALE AND FEMALE HOUSINGS OF AN ELECTRIC CONNECTOR

This application is a continuation of application Ser. No. 561,394, filed Jul. 31, 1990, now abandoned.

BACKGROUND OF THE INVENTION

1. Field of the Invention

The present invention relates to a tool for separating male and female housings of an electric connector. More particularly, it relates to such a separating or decoupling tool which makes use of the slots of a male housing for separating and removing a male housing from an associated female housing with ease.

2. Description of the Prior Art

In electric appliances a plurality of terminals each connected to an electric wire are connected to a plurality of counter terminals. For example, a plurality of male terminals each connected to an electric wire are electrically connected to a plurality of female terminals each connected to a selected conductor in a printed board. In some instances terminals of one type used in an electric appliance are not equal in number to terminals of the other type. Also, terminal of one type combined together are electrically connected to or disconnected from terminals of another type combined together.

Usually in such a case a group of terminals of one type each connected to an electric wire are inserted in corresponding slots of a male housing, whereas a group of terminals of the other type are mounted in a female housing. Thus, the terminals of one type can be electrically connected to or disconnected from the terminals of the other type at the same time simply by separating the male housing from the female housing. Specifically a group of male terminals can be electrically connected to or disconnected from a group of female terminals simply by coupling or decoupling the male housing from the female housing. The number of male or female terminals to be fitted in the male or female housing can be selected to meet occasional demands in designing.

As for the separating of the male housing from the female housing, usually the top of the male housing, appearing a little above the female housing, is squeezed between fingers. Thereafter the male housing can be pulled away and removed from the female housing. Separation is likely to be performed by holding and pulling a bundle of electric wires which are connected to the male housing. This manner of separation is most likely to be performed in case of connectors of small size.

In the case of a connector having a sufficient number of terminals and of a male connector housing have as many male terminals as there are female terminals, a bundle of electric wires extending from the male terminals may be strong enough to resist against breaking when the male housing is pulled apart from the female housing by the bundle of electric wires. However, in the case of a male housing having fewer male terminals than there are female terminals, a bundle of electric wires extending from the male terminals may be not strong enough and therefore, the electric wires or terminals may break.

SUMMARY OF THE INVENTION

One object of the present invention is to provide new and improved means for easily separating and removing a male housing from an associated female housing without holding a bundle of electric wires extending from the male housing, thereby eliminating the possibility of electric wire breaking which otherwise, might be caused by pulling the bundle of electric wires. Another object of the present invention is to provide means for easily separating and removing a male housing from a female housing without structurally modifying existing male housings. Still another object of the present invention is to provide means to be applied to all connectors in disconnecting their male and female housings no matter what number of poles they may have without modifying existing male housings. Still another object of the present invention is to provide such a separating tool which can be produced at a very low cost.

To attain these objects a new and improved means for pulling and removing a male housing away from the receptacle space of a female housing is provided with the male housing having a plurality of apertures or slots to accommodate terminals therein and with each terminal having a length of wire connected thereto. The means comprises a shank and a tool body integrally connected thereto, with the tool body being adapted to fit in any of the apertures or slots in the male housing and being capable of locking and unlocking the tool body in any one of the apertures or slots.

Other objects and advantages of the present invention will be understood after reviewing separating tools according to the first and second embodiments of the present invention which are shown in the accompanying drawings.

DESCRIPTION OF DRAWINGS

FIG. 1 is a perspective view of male and female housings, terminals each connected to electric wires, and the separating tool.

FIG. 2 is a longitudinal section of the male and female housing mounted together and the separating tool, which is inserted in a selected terminal slot of the male housing.

FIG. 3 is a longitudinal section of the male and female housings separated, and the separating tool which is inserted in a selected terminal slot of the male housing.

FIG. 4 is a longitudinal section showing how the separating tool is removed from the male housing.

FIG. 5 is a front view of the separating tool.

FIG. 6 is a right side view of the separating tool.

FIG. 7 is a rear view of the separating tool.

FIG. 8 is a top view of the separating tool.

DETAILED DESCRIPTION OF THE INVENTION

Figure 1:
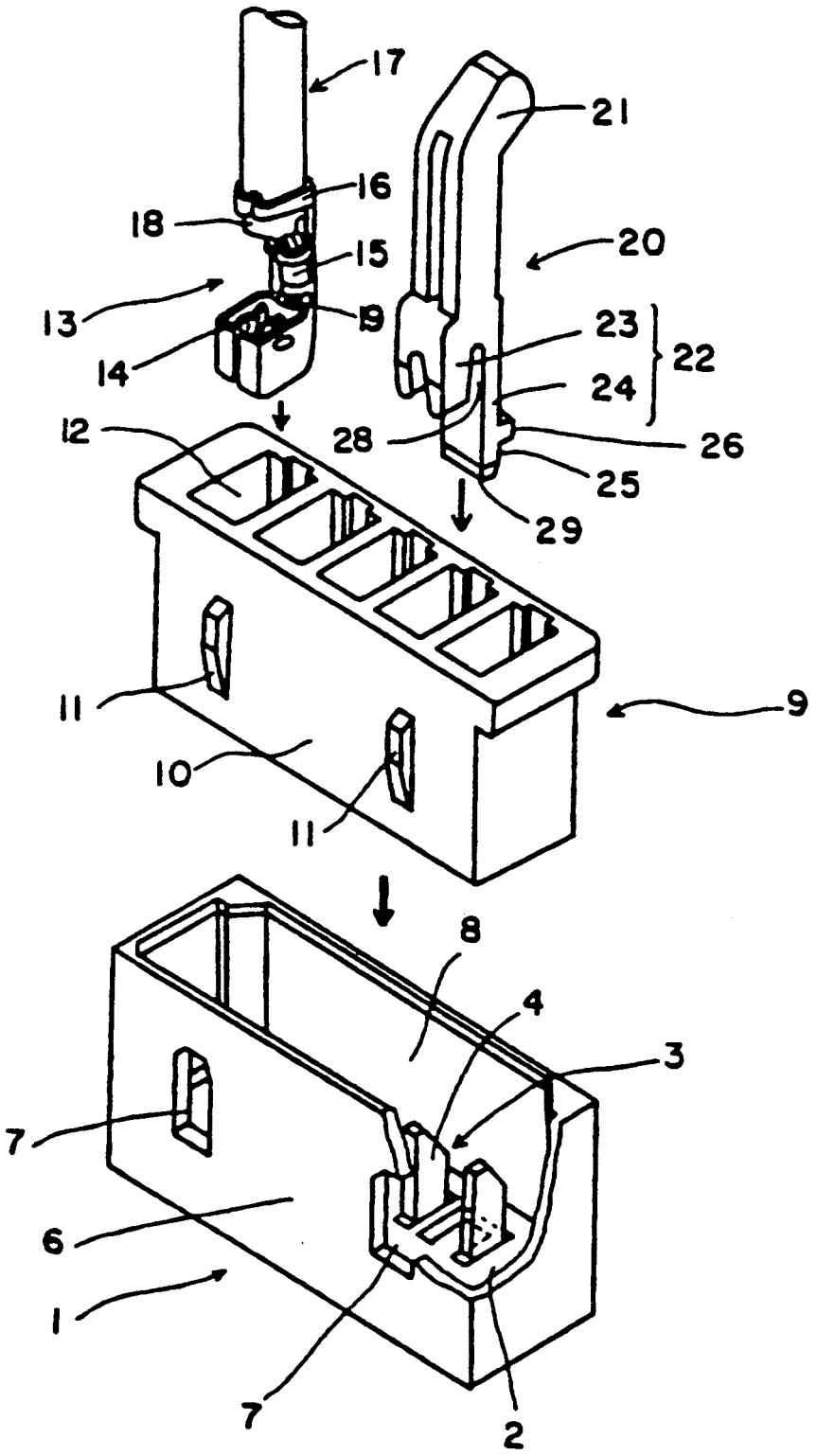
FIGS. 1 to 4 show the first embodiment of the present invention.

In use, first, before coupling the male housing 9 to the female housing 1 of a connector, the tool body 22 is inserted in a slot 12 which is selected among those which are not used in the male housing 9. After the tool 20 is fully inserted into locking position, the male housing 9 is coupled to the female housing. In this position the male terminals 3 of the male housing 1 are mated with corresponding female terminals 13 in the female housing 9. If it is desired that the male housing 9 be separated and removed from the female housing 1, the male housing 9 is pulled up from the female housing 1 by pulling the shank 21 of the tool 20. Thereafter, the tool 20 is put in its unlocking position, and the tool 20 is pulled apart from the male housing 9.

In the accompanying drawings terminals 13 which are fitted in selected terminal slots 12 of the male housing 9 are shown as a receptacle type whose end 15 is crimped to the stripped end 19 of the insulated conductor 17. Terminals 3 which are fitted in selected terminal slits of the female housing 1 are shown as being soldered at their tails 5 to selected conductors in a printed board (not shown). Thus, the electric connector which is composed of the male 9 and female 1 housing, is used to connect selected conductors in the printed board to a bundle of electric wires.

In FIG. 1 the female housing 1 has a plurality of terminals 3 arranged laterally at regular intervals on its bottom 2. Specifically the contact ends 4 of these terminals 3 appear inside, and the tails 5 of the terminals 3 appear outside. The front wall 6 of the female housing 1 has lock slits 7 made therein. The male housing 9 is designed to fit in the receptacle space or recess 8 of the female housing 1. The male housing 9 has lock projections 11 on its front wall 10 at such position that they may be caught by the lock slits 7 upon insertion into the recess 8 of the female housing 1. Also, the male housing 9 has terminal slots 12 (in this example, 5 slots) made at the same intervals as the terminals 3 in the female housing 1.

A terminal 13, which is to be inserted in a selected terminal slot 12 of the male housing 9, is composed of contact section 14, conductor holding section 15 and insulation holding section 16. As seen from FIG. 1, the conductor holding section of the terminal 13 is crimped to the stripped end 19 of the electric wire 17. The insulation holding section 16 is crimped to the insulation 18 of the electric wires 17.

Referring to FIGS. 1 to 4 there is shown a separating tool according to one embodiment of the present invention. The tool 20 is composed of a shank 21 and a body 22 integrally connected to the shank 21. In this particular embodiment the shank 21 has a dogleg shape. The shape and size of the tool body 22 is designed so as to fit in a selected slot 12, and is further designed to prevent the tool body 22 from slipping off from the terminal slot once the tool body 22 has been inserted, and to release the tool body 22 from the terminal slot when demanded. In this particular embodiment the tool body 22 comprises a major (wide and short) extension 23 and a minor (narrow and long) extension 24 integrally connected to the shank 21 in the form of a fork, forming a longitudinal slot 28 therebetween. The minor extension 24 has a projection 26 on its far side 25 to lock the tool body 22 to the rear wall of the slot 12 by allowing the projection 26 to fit in a recess or hole 27, which is made to catch and hold a selected terminal 13 in a similar way. The rear wall of each terminal slot in the male housing 9 has an incline 30 to guide a male terminal 13. This incline 30 may be used to guide the tool body 22, thereby leading the forward end of the tool body 22 in the terminal slot until the lock projection 26 of the minor extension 24 of the tool body 22 fits in the lock recess 27 on the rear wall of the terminal slot.

The longitudinal slot 28 between the major and minor extensions 23 and 24 of the tool body 22 permits the unlocking of the tool body 22 in the male housing 9 when an external force is applied to the shank 21 of the tool 20. Application of external force to the shank 21 of the tool 20 causes the minor extension 24 of the tool body 22 to yieldingly bend towards the major extension 23 until the lock projection 26 comes out of the lock recess 27 on the rear wall of the male housing 9. Release of external force will permit the minor extension 24 of the tool body 20 to resiliently return to its initial, stress-free position.

Figure 2:
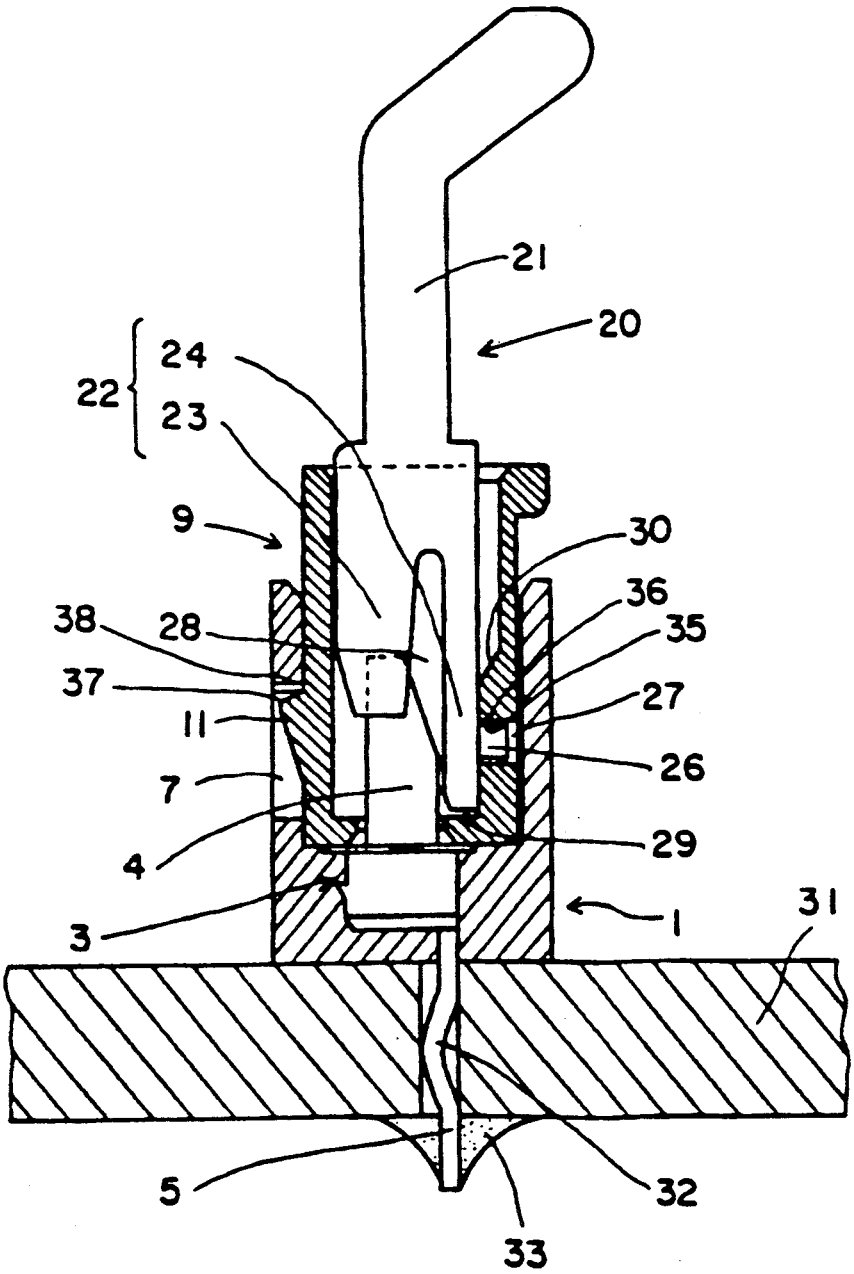

One example of using such a separating tool is described below. FIG. 2 shows the male and female housings 9 and 1 mated together, thereby electrically connecting a bundle of conductors 17 to selected conductors on a printed board 31 via the terminals 13 of the male housing 9 and the terminals 3 of the female housing 1. As shown, the tail section 5 of each terminal 3 passes through a selected conductor as indicated at 33. When it is desired, the terminals of the male housing 9 are simultaneously decoupled from the terminals of the female housing 1, thereby disconnecting the bundle of conductors 17 from the printed circuit. The male housing 9 can be separated from the female housing 1 simply by gripping the shank 21 of the separating tool 20 and pulling it up. Then, the male housing 9 is separated from the female housing 1. When the male housing 9 is pulled up, the lock projections 11 of the male housing 9 side off from the lock slits 7, thus allowing the male housing 9 to leave the receptacle space of the female housing 1. The locking of the lock projections 11 of the male housing 9 to the lock slits 7 in the front wall of the female housing 1 is selected to be less tight than the locking of the lock projection 26 of the tool to the lock recess 27 in the rear wall of the male housing 9. In this example the lock projection 26 has a flat top surface 35 to permit close fitting to the flat ceiling 36 of the lock recess 27 whereas the lock projection 11 has a slant surface 37 to permit a limited contact to the ceiling 38 of the lock slit 7.

Figure 3:
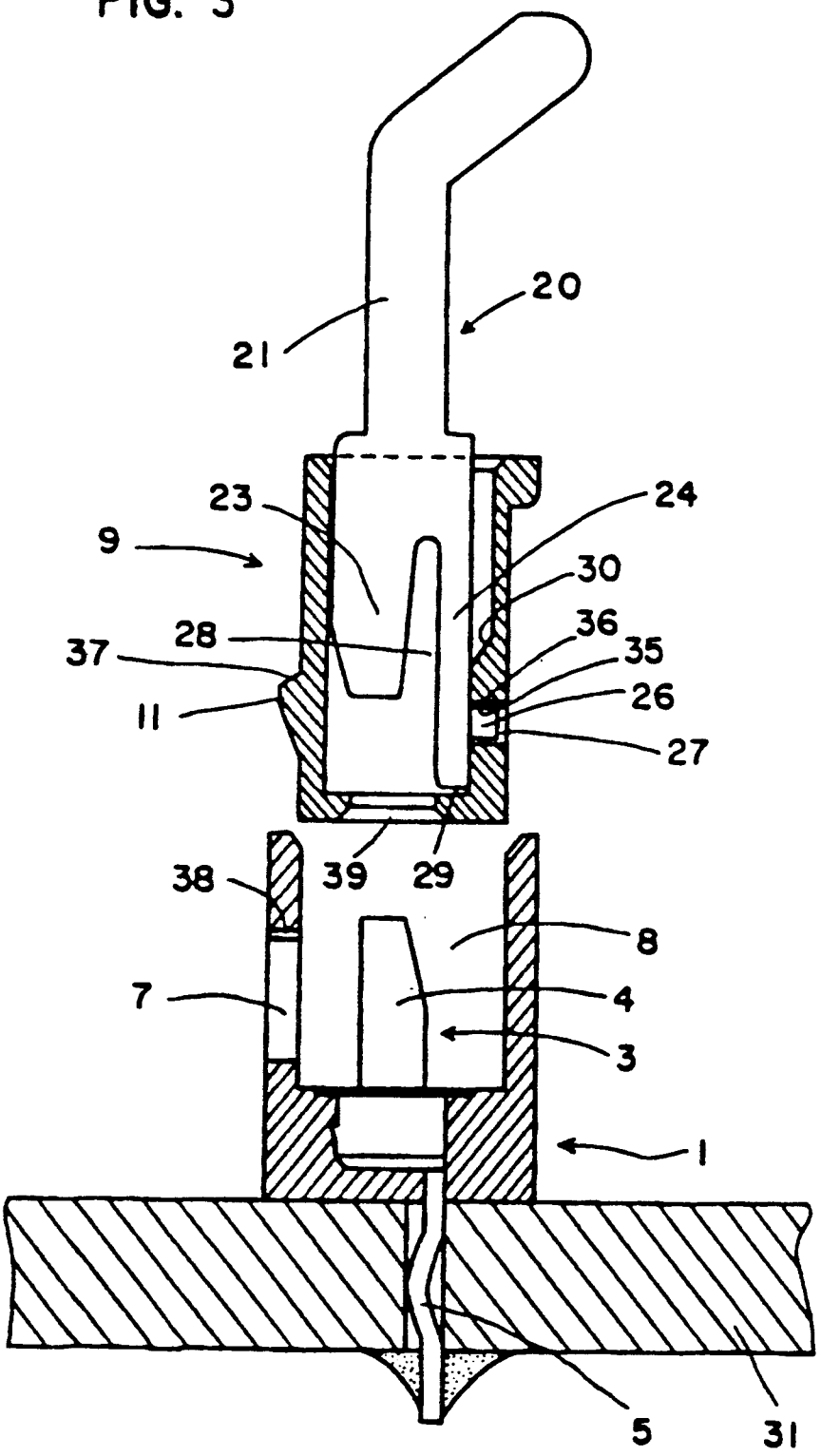
Figure 4:
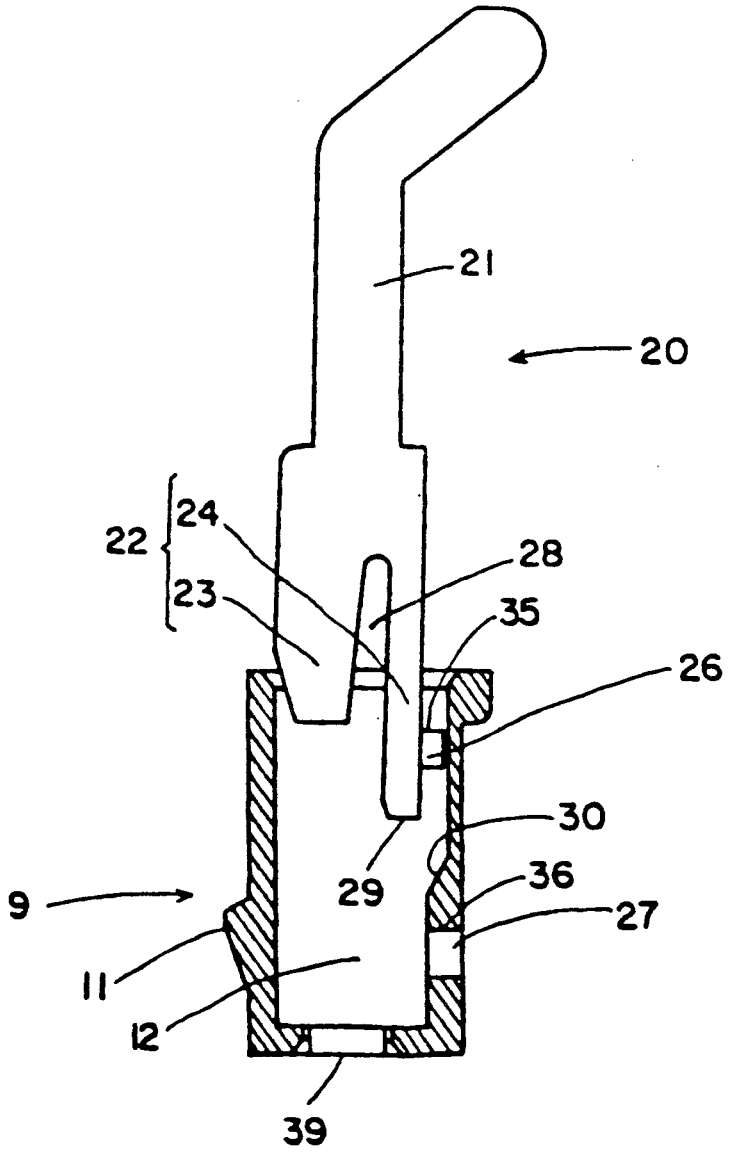
Figure 7:
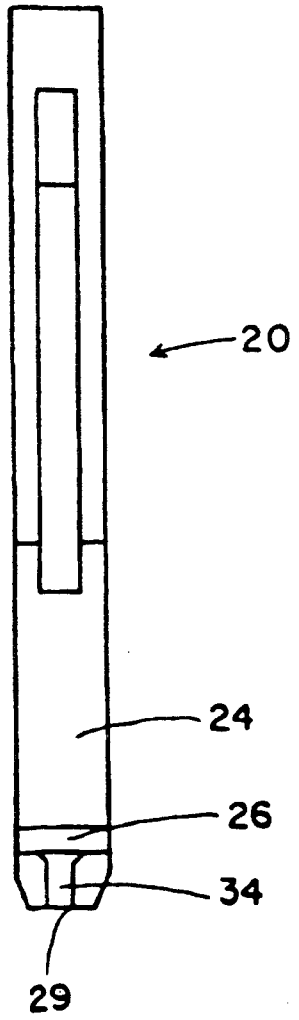
FIGS. 5 to 8 show another separating tool.
Figure 8:
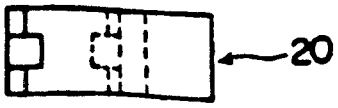

FIG. 3 shows the male housing 9 separated from the female housing 1. Thus the bundle of electric wires 17 is disconnected from the printed board 31. When, it is desired that the tool 20 be removed from the male housing 9, the minor extension 24 of the body 22 should be bent towards the major extension 23. This will reduce the longitudinal slot 28 of the body 22 until the lock projection 26 of the tool body 22 leaves the lock recess 27 on the rear wall of the terminal slot 12, as shown in FIG. 4.

To insert a separating tool 20 into a selected terminal slot 12 in the male housing 9, the shank 21 of the tool 20 is held in hand, and the tool 20 is placed in a terminal slot 12 which is selected among those remaining unoccupied by terminals 13. In the course of insertion, the forward end 29 of the minor extension 24 of the tool body 22 comes into contact with the inclination 30 on the rear wall of the male housing 9, and then the minor extension 24 of the body 22 slides on the inclination 30, yieldingly bending towards the major extension 23 of the tool body 22.

When the tool 20 reaches the final position, it will be locked with its projection 26 locked in the recess 27 on the rear wall of the male housing 9. When the male housing 9 with the tool 20 inserted therein, is mated with the female housing 1, the tool 20 can be firmly fixed to the male housing 9 because the contact piece 4 is allowed to wedge between the major and minor extensions 23 and 24 of the tool body 20.

As may be understood from the above, the male housing 9 can be removed and separated from the female housing 1 without pulling the bundle of electric wires 17 which are connected to the terminals 13 in the male housing 9. The tool cannot bend yieldingly when external force is applied to the tool, and therefore, the male housing 9 can be separated from the female housing 1 easily. As described earlier, the tool body 22 is designed in size and shape so as to fit in any terminal slots of the male housing. The tool body 22 is also designed to be caught by the lock recess of the terminal slot, which lock recess is made to catch the terminal when inserted in the terminal slot. Therefore, a single tool can be applied to existing male housings without modification no matter what number of terminal slots the male housing may have. Separating tools can be made at low cost because of no requirement of modification in male housings and no requirement of different molds to make separating tools.

Figure 5:
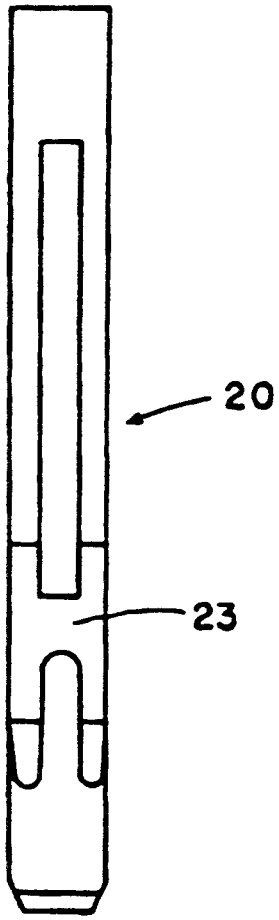
Figure 6:
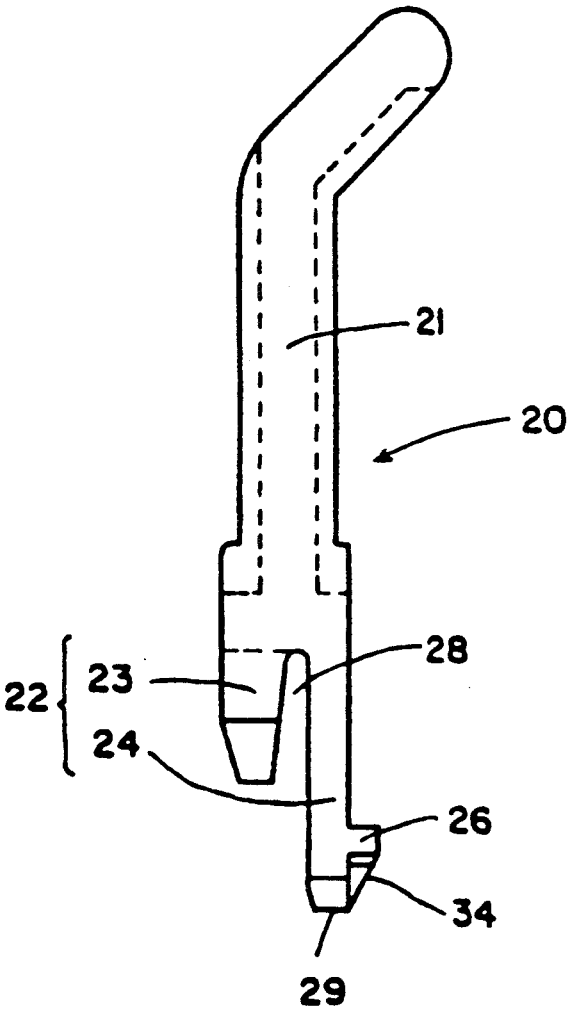
Figure 9:
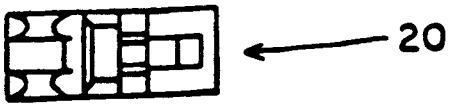
FIG. 9 is a bottom view of the separating tool.

FIG. 5 and subsequent figures show a separating tool according to a second embodiment of the present invention. It is different from the first embodiment in that the lock projection 26 on the rear side of the minor extension 24 of the tool body 20 has a tapering guide piece 34 integrally connected to the lock projection 26. The tapering guide facilitates insertion of the tool into a selected terminal slot 12 in the male housing 9, and at the same time, the tapering guide reinforces the lock projection 26 on the minor extension 24 of the tool body 20. A set of separating tools which are designed to be applied to male housings of different shapes and sizes, may be prepared. The locking and unlocking means of such separating tools may be designed to fit into different male housings relative to their lock recess shape and position. The separating tool is described as being applied to disconnect electric circuits between the bundle of electric wires and the printed board. As a matter of course it can also be used to disconnect the male and female housings from each other.

We claim as our invention:

1. A tool for separating a male housing portion of a connector from a female housing portion, the male housing releasably held within the female housing by a locking arrangement which is designed to release when a predetermined separation force is applied to the male housing, the male housing further having a plurality of apertures, each adapted to accommodate a wire terminating terminal and a locking recess located in one of the walls of the aperture, the tool comprising a shank portion and body portion of a size and shape so that the body portion is insertable into any one of the apertures, said body portion bifurcated into two legs with a slot therebetween with one leg shorter than the other said body portion having a projection on the longer of the two legs which engages with said locking recess when the body portion is inserted into the aperture, whereby said predetermined separation force may be applied to the shank portion of the tool to separate the male housing portion from the female housing portion and further whereby placing a lateral force on said tool shank portion will cause the longer leg to bend toward said slot between both legs causing the projection to disengage from the locking recess allowing the body portion of the tool to be withdrawn from The aperture.

2. A separating tool in accordance with claim 1, wherein the projection has a leading tapered surface to facilitate its entry into the aperture.

3. A separating tool in accordance with claim 2, wherein the projection has a trailing surface which is substantially perpendicular to the longitudinal axis of the tool and is substantially parallel to the engaging surface of the locking recess.

* * * * *